US008397546B2

(12) United States Patent
Varney et al.

(10) Patent No.: US 8,397,546 B2
(45) Date of Patent: Mar. 19, 2013

(54) CABINET SECURITY SYSTEM

(75) Inventors: Jim R. Varney, Maynard, MA (US); Bryan R. Hotaling, Harvard, MA (US); Scott A. Leclerc, Ashby, MA (US); Jim Ormond, Watertown, MA (US); Chuck Buckavich, Attleboro, MA (US)

(73) Assignee: Cosco Management, Inc., Wilmington, DE (US)

( * ) Notice: Subject to any disclaimer, the term of this patent is extended or adjusted under 35 U.S.C. 154(b) by 288 days.

(21) Appl. No.: 12/887,342

(22) Filed: Sep. 21, 2010

(65) Prior Publication Data

US 2012/0067090 A1 Mar. 22, 2012

(51) Int. Cl.

| | |
|---|---|
| ***E05B 47/00*** | (2006.01) |
| ***E05B 65/00*** | (2006.01) |
| ***E05B 65/44*** | (2006.01) |
| ***E05B 65/46*** | (2006.01) |
| ***E05B 19/26*** | (2006.01) |
| ***E05C 17/56*** | (2006.01) |

(52) U.S. Cl. ..... 70/276; 70/57; 70/77; 70/81; 70/85; 70/413; 292/194; 292/251.5

(58) Field of Classification Search ..... 70/276, 70/77, 81, 85–88, 413; 292/194, 251.5, 37
See application file for complete search history.

(56) References Cited

U.S. PATENT DOCUMENTS

| | | | | |
|---|---|---|---|---|
| 2,730,392 | A * | 1/1956 | Thiebaud | 292/201 |
| 2,970,857 | A * | 2/1961 | Squire | 292/251.5 |
| 3,388,938 | A * | 6/1968 | Peterson | 292/177 |
| 3,563,587 | A * | 2/1971 | Hughes et al. | 292/194 |
| 3,584,485 | A * | 6/1971 | Peterson | 70/276 |
| 3,600,025 | A * | 8/1971 | Brainard | 292/251.5 |
| 3,744,833 | A * | 7/1973 | Berducone | 292/251.5 |
| 4,290,285 | A * | 9/1981 | Bela et al. | 70/276 |
| 4,425,771 | A * | 1/1984 | Beach et al. | 70/276 |
| 4,848,812 | A | 7/1989 | Slaughter | |
| 4,919,464 | A | 4/1990 | Richards | |
| 4,969,723 | A | 11/1990 | Kato et al. | |
| 5,076,623 | A | 12/1991 | Richards | |
| 5,188,405 | A | 2/1993 | Maccaferri | |
| 5,485,733 | A | 1/1996 | Hoffman | |
| 5,605,065 | A * | 2/1997 | Lopez-Casals et al. | 70/276 |
| 7,234,739 | B2 * | 6/2007 | Saitoh et al. | 292/251.5 |
| 2007/0113605 | A1 * | 5/2007 | Lopez | 70/276 |

FOREIGN PATENT DOCUMENTS

WO WO 9203631 A1 * 3/1992

* cited by examiner

*Primary Examiner* — Christopher Boswell
*Assistant Examiner* — Eric Kurilla
(74) *Attorney, Agent, or Firm* — Barnes & Thornburg LLP

(57) ABSTRACT

A cabinet security system in accordance with the present disclosure includes a retractable latch associated with a cabinet drawer or door and a latch blocker coupled to a cabinet frame. A magnet is used to retract the latch to unlock the drawer for movement relative to the frame.

26 Claims, 5 Drawing Sheets

UNLOCKED
INTERNAL KEY
UNLOCKED WITH INTERNAL KEY
LOCKED
INTERNAL KEY
MAGNETIC EXTERNAL KEY

CABINET SECURITY SYSTEM

BACKGROUND

The present disclosure relates to a cabinet security system, and in particular, to keys for operating cabinet locks. More particularly, the present disclosure relates to a magnetic system for locking and unlocking a cabinet.

SUMMARY

A cabinet security system in accordance with the present disclosure includes a retractable latch associated with a cabinet drawer or door and a latch blocker coupled to a cabinet frame. A magnet is used to retract the latch to unlock the drawer for movement relative to the frame.

In illustrative embodiments, a latch actuator is located in an actuator housing and coupled to the latch. The latch actuator includes a pivotable rocker, a motion-transfer link coupled to one end of the rocker and to the latch, and an internal magnet coupled to the other end of the rocker. In use, a magnetic external key is placed on an outer wall of a panel included in a locked drawer. A magnetic field associated with the magnetic external key attracts the internal magnet coupled to the rocker and located inside the locked drawer. Such a magnetic attraction causes the rocker to pivot and the motion-transfer link to move so that the latch is moved from an extended position engaging the latch blocker to a retracted position disengaging the latch blocker. This frees the drawer to be moved from the closed position to an opened position.

In illustrative embodiments, when the drawer is opened, an internal key mounted for movement relative to the actuator housing can be moved by a user to hold the latch in a semi-permanent retracted position without using the magnetic external key. In illustrative embodiments, a user slides the internal key relative to the actuator housing from an inactive position to an active position. This causes the internal key to engage and move the rocker so that the latch is retracted. The latch will remain in the retracted position to disable the latch as long as the internal key is left in the active position.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which:

FIG. 9 is an enlarged sectional view taken along lines 9-9 of FIG. 8;

DETAILED DESCRIPTION

Figures 1, 2, 3:
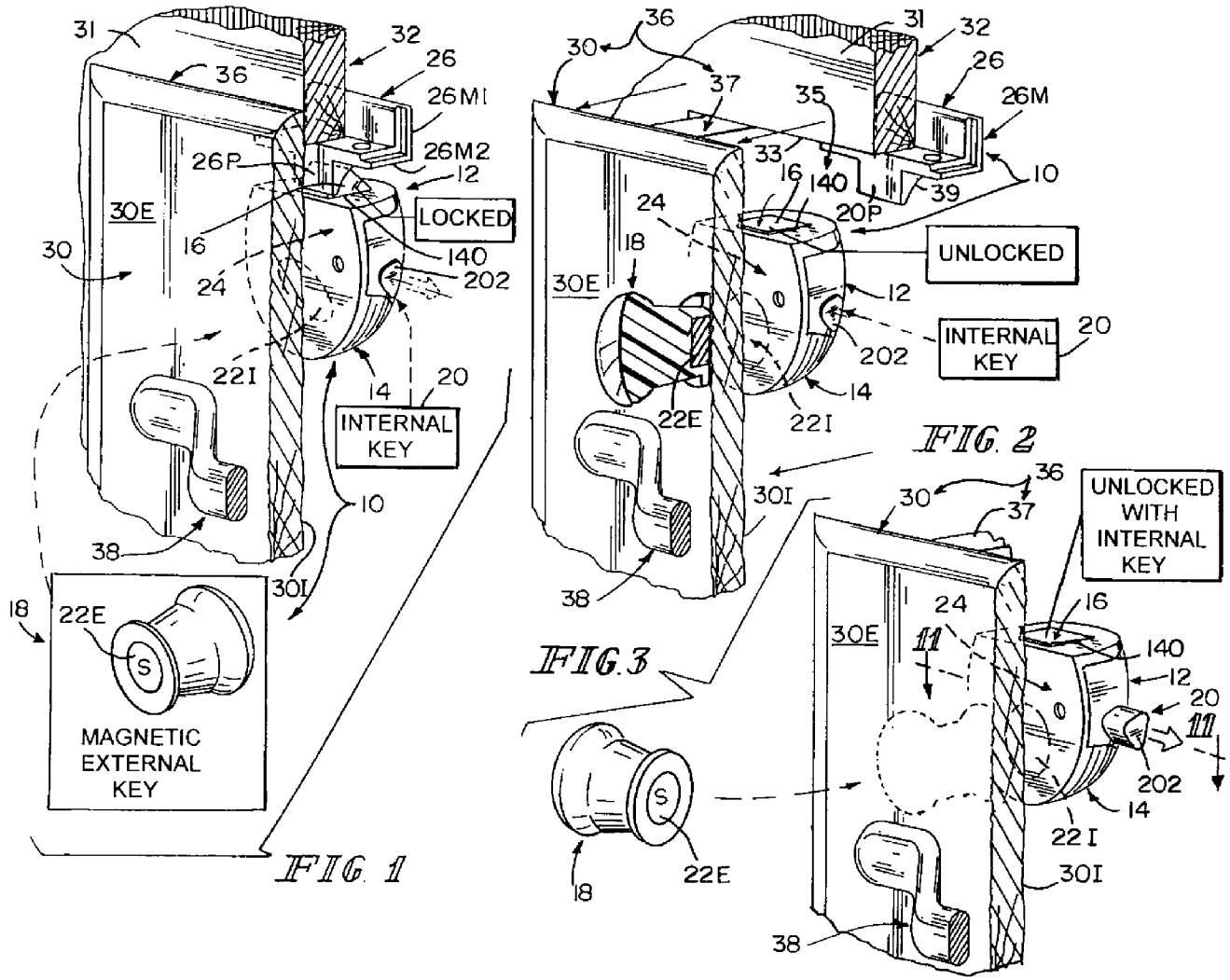
FIG. 1 is a perspective view of a cabinet security system for use in blocking movement of a panel relative to a cabinet frame and showing that the system includes (1) a panel motion controller mounted on an interior wall of a panel included in a cabinet drawer and shown in a locked condition wherein a movable latch included in the panel motion controller mates with a latch plate included in a latch blocker coupled to the cabinet frame, (2) a magnetic external key separated from the cabinet and adapted to mate with an exterior wall of the panel, and (3) an internal key mounted for back-and-forth sliding movement in the panel motion controller between an inactive position shown, for example, in FIGS. 1, 2, 5-7, and 10 and an active position shown, for example, in FIGS. 3, 11, and 12.
FIG. 2 is a view similar to FIG. 1 showing movement of the cabinet drawer to an opened position after the magnetic external key was placed on the exterior wall of the drawer panel to attract a magnet included in a latch actuator located in an interior region of an actuator housing included in the panel motion controller as suggested in FIGS. 6 and 9 to cause a latch to move from the extended position shown in FIG. 1 to the retracted position shown in FIG. 2 so as to disengage the latch plate and free the cabinet drawer to be moved to an opened position.
FIG. 3 is a view similar to FIGS. 1 and 2 showing that a person can (while the cabinet drawer is opened) slide the internal key relative to the panel motion controller from the inactive position shown in FIGS. 2, 7, and 10 to the active position shown in FIGS. 3, 11, and 12 to move the latch actuator to hold the latch in the retracted position (whether or not the magnetic external key is placed on the exterior surface of the drawer panel) so that the latch is retained in the retracted position without use of the magnetic external key.

A cabinet security system 10 in accordance with the present disclosure includes a magnetic external key 18, an internal key 20, and a panel motion controller 12 including a retractable latch 16, a latch actuator 24 coupled to latch 16, and an actuator housing 14 as suggested in FIGS. 1-3. In one mode of operation, an external magnet 22E included in magnetic external key 18 can be used to attract an internal magnet 22I included in latch actuator 24 to cause latch actuator 24 to move inside actuator housing 14 so as to cause latch 16 to retract and move from an extended position engaging a companion latch blocker 26 as suggested in FIGS. 1, 5, and 6 to a retracted position disengaging latch blocker 26 as suggested in FIGS. 2, 8, and 9. In another mode of operation, internal key 20 can be moved manually between an inactive position shown in FIGS. 1, 2, 7, and 10 to an active position shown in FIGS. 3, 11, and 12 to move latch actuator 24 inside actuator housing 14 and restrain latch actuator 24 so as to hold latch 16 in the retracted position without using magnetic external key 18.

In an illustrative embodiment, actuator housing 14 of panel motion controller 12 is mounted on an interior wall 301 of a panel 30 while magnetic exterior key 18 is adapted to mate with an exterior wall 30E of panel 30 as suggested in FIGS. 1, 2, 8, and 9. It is within the scope of this disclosure to include panel 30 in a cabinet drawer or door. It is also within the scope of this disclosure to use panel motion controller 12 to retain panel 30 in a closed position engaging a cabinet frame 32 as suggested in FIGS. 1, 5, and 6.

Panel motion controller 12 is suited for controlling motion of a panel 30 included in a cabinet 34 as suggested in FIGS. 1-3. In illustrative embodiments, cabinet 34 includes a cabinet frame 32 formed to include an aperture 33 opening into an interior region 35 formed in cabinet 34 as suggested in FIG. 2. Cabinet frame 32 includes a top strip 31 and latch blocker 26 is coupled to top strip 31 and arranged to extend downwardly into interior region 35 of cabinet 34 as suggested in FIGS. 1, 2, 5, 6, 8, and 9 in an illustrative embodiment.

Panel 30 is included in a cabinet drawer 36 as suggested in FIGS. 1-3. Cabinet drawer 36 also includes a drawer frame 37 arranged to extend through aperture 33 into interior region 35 of cabinet 34 as suggested in FIG. 2. Drawer frame 37 is mounted for movement relative to cabinet frame 32 to support panel 30 for movement relative to cabinet frame 32 to open and close aperture 33. Panel 30 is shown in a closed position in FIGS. 1, 6, and 9 and in an opened position in FIGS. 2 and 3. It is within the scope of this disclosure to mount a pull handle 38 on exterior wall 30E of panel 30 as suggested in FIGS. 1-3. It is also within the scope of this disclosure to include panel 30 in a cabinet door (not shown) mounted for pivotable or other movement relative to cabinet frame 32 to open and close aperture 33.

Normally, latch 16 is urged by a latch-return spring 42 to the extended position engaging latch blocker 26 when cabinet drawer 34 is closed. To unlock drawer 34, a user places magnetic external key 18 on exterior wall 30E of panel 30 to attract an internal magnet 22I provided in latch actuator 24 on the other side of panel 30. This attraction causes latch actuator 24 to move relative to panel 30 and retract latch 16 inside actuator housing 14 to disengage latch blocker 26 and free drawer 34 to be opened.

Once cabinet drawer 34 is opened using magnetic external key 18, a user can access interior key 20 and move it relative to actuator housing 14. As interior key 20 slides from the inactive position shown in FIGS. 7-10 to the active position shown in FIGS. 11 and 12, it pushes against latch actuator 24, causing the latch actuator 24 to move and retract latch 16 inside actuator housing 14 as suggested in FIG. 3. In the active position, interior key 20 is arranged to hold latch 16 in the retracted position so that the drawer 34 can be opened and closed without having to use the magnetic external key 18 to retract the latch 16 as suggested in FIG. 3.

Latch blocker 26 includes a latch plate 26P and a latch mount 26M coupled to latch plate 26P as shown, for example, in FIGS. 1, 2, and 4-6. Latch mount 26M is coupled to top strip 31 of cabinet frame 32 to support latch plate 26P in a position in interior region 35 of cabinet 34 to mate with latch 16 when latch 16 has been moved to its extended position and panel 30 is closed as suggested in FIGS. 1, 5, and 6. In illustrative embodiments, latch plate 26P includes a concave surface 39 configured to mate with latch 16. Latch mount 26M includes a rear flange 26M1 configured to mate with a rear surface of top strip 31 and a bottom flange 26M2 configured to mate with a bottom surface of top strip 31 and interconnect latch plate 26P and rear flange 26M1. Fasteners 26F are provided to extend through apertures formed on bottom flange 26M2 and engage top strip 31 to retain latch blocker 26 in a fixed position on cabinet 34 as suggested in FIGS. 1, 2, and 4-6.

Figure 4:
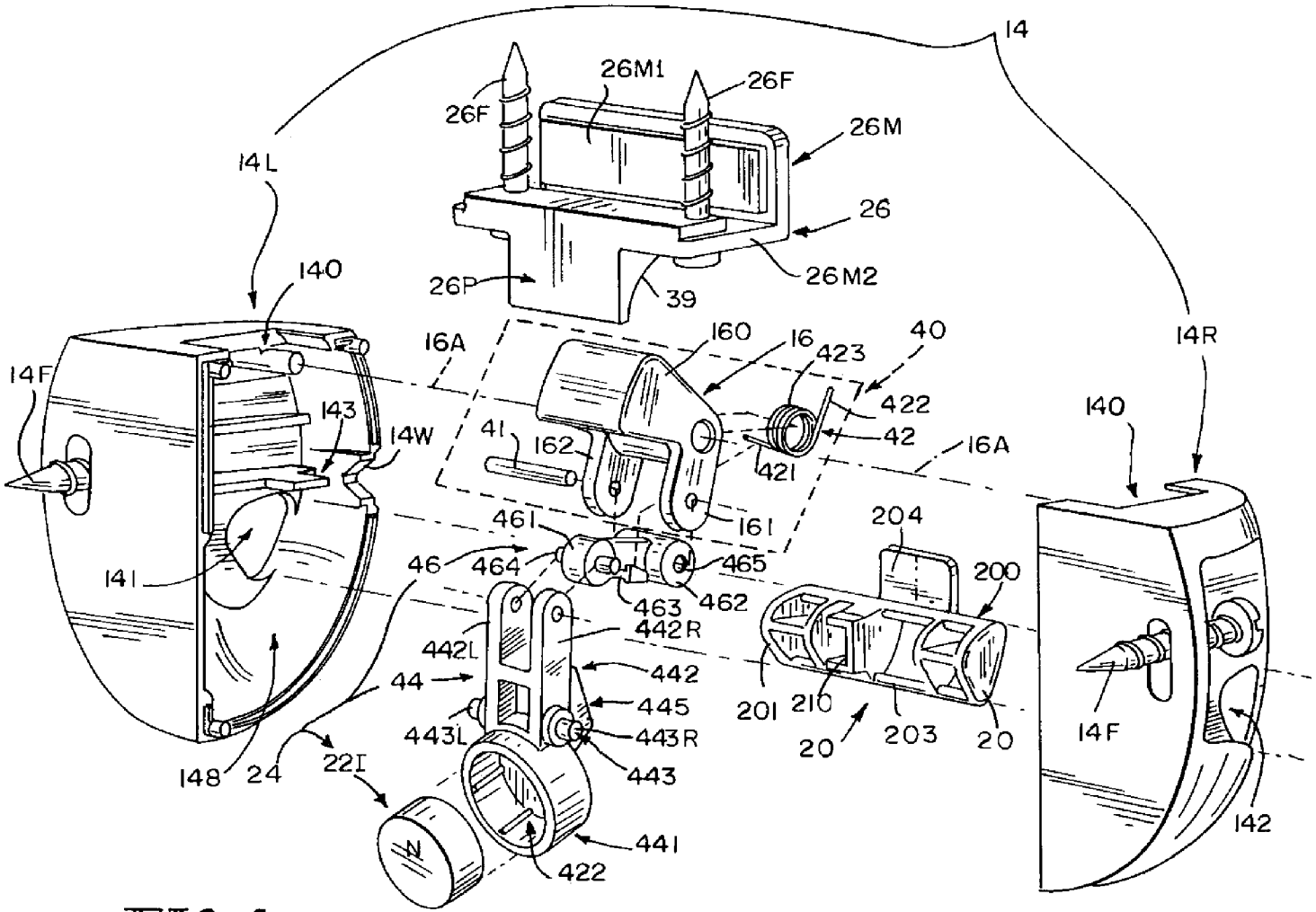
FIG. 4 is an exploded perspective assembly view of components included in the panel motion controller and the companion latch blocker along with a perspective view of the internal key with its horizontally extending handle sized and shaped to extend through and in triangle-shaped openings formed in left-side and right-side shells included in the actuator housing and vertically extending guide flange sized and shaped to move back and forth in a flange-receiving channel formed in the left-side shell of the actuator housing during movement of the handle in the triangle-shaped openings formed in the left-side and right-side shells.
Figure 5:
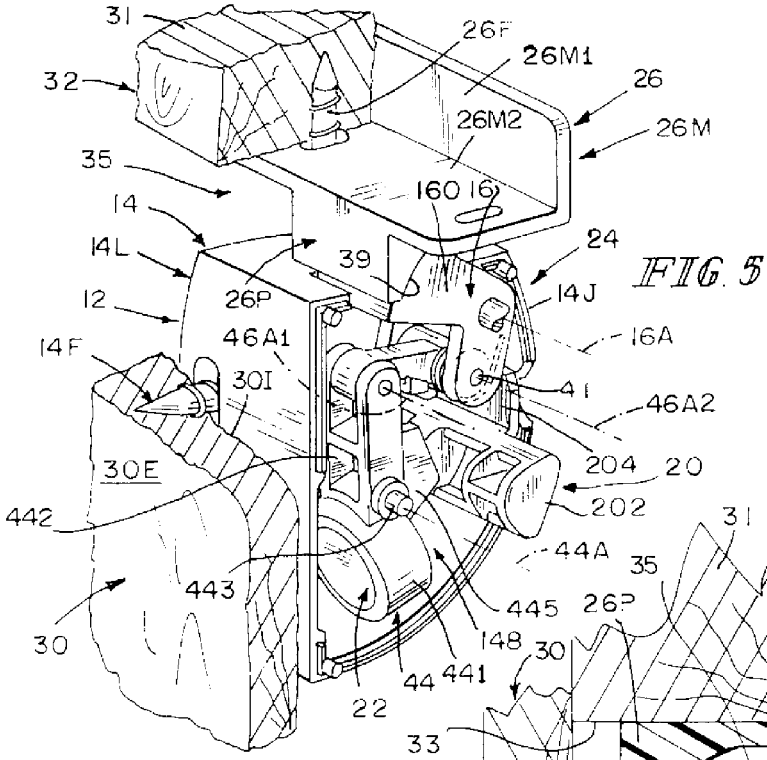
FIG. 5 is a perspective view of the cabinet security system of FIG. 1 with the right-side shell of the actuator housing removed to show the location of the components included in the latch actuator when the latch is in the extended position mating with the latch plate included in the latch blocker.

As suggested in FIGS. 1, 4, and 5, actuator housing 14 is formed to include a latch window 140 opening downwardly into a latch chamber 148 formed in actuator housing 14. Latch actuator 24 is movable in latch chamber 148 as suggested in FIGS. 6 and 8 to cause latch 16 to move upwardly through latch window 140 as latch 16 is moved between the extended and retracted positions. In an illustrative embodiment, actuator housing 14 comprises a left-side shell 14L coupled to a right-side shell 14R along a joint 14J to form latch window 141 and latch chamber 142 as suggested in FIGS. 4-7. Fasteners 14F are used to retain actuator housing 14 in a fixed position on interior wall 301 of panel 30 as suggested in FIGS. 4 and 5.

A panel lock 40 is included in panel motion controller 12 as suggested in FIG. 4. In illustrative embodiments, panel lock 40 comprises retractable latch 16, latch axle 41, and latch-return spring 42. Latch axle 41 is coupled to actuator housing 14 as suggested in FIGS. 4 and 5. Latch 16 is mounted for pivotable movement on latch axle 41 relative to the actuator housing 14 about a latch pivot axis 16A between an extended position extending upwardly through the latch window 140 to lie in confronting relation to the latch blocker 26 when the panel 30 is closed as suggested in FIG. 1 and a retracted position lying in the latch chamber 148 to disengage the latch blocker 26 to free the panel 30 for movement relative to the frame 32 to an opened position as suggested in FIG. 2.

Figure 6:
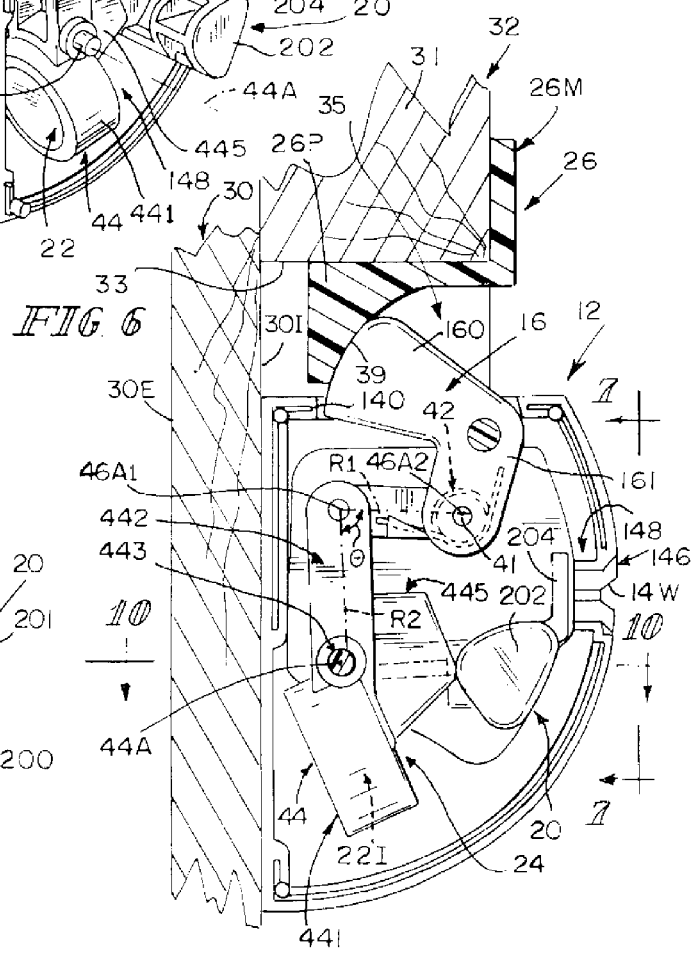
FIG. 6 is an enlarged sectional view taken along lines 6-6 of FIGS. 1 and 5.

Latch actuator 24 is located in the latch chamber 148 as suggested in FIGS. 5 and 6. Latch actuator 24 is configured to provide means for moving the latch 16 from the extended position to the retracted position in response to exposure to a magnetic field produced by the magnetic external key 18 when the magnetic external key 18 is mated with the exterior wall 30E of the panel 30 as suggested in FIGS. 6 and 9. Latch actuator 24 includes a rocker 44, a motion-transfer link 46, and internal magnet 22I as shown, for example, in FIGS. 4 and 5.

Figure 8:
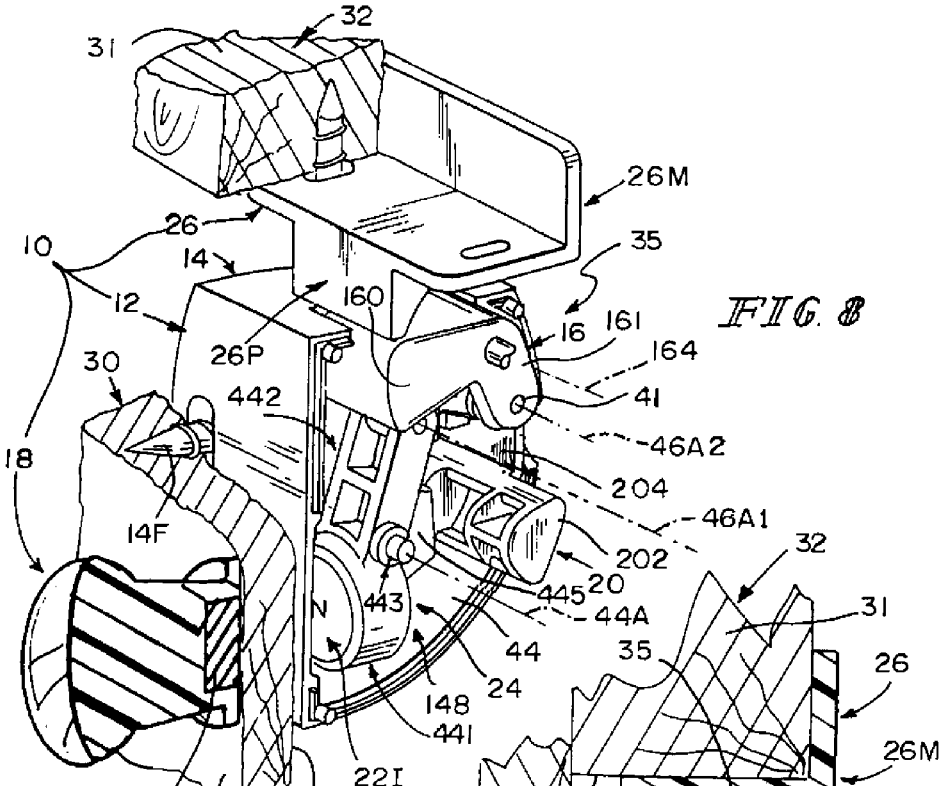
FIG. 8 is a perspective view similar to FIG. 5 showing the location of the components included in the latch actuator when the magnetic external key is positioned on the actuator housing to attract a magnet included in the latch actuator and cause the latch actuator to pivot the latch to assume a retracted position disengaging the latch plate.

Rocker 44 is mounted for pivotable movement relative to the actuator housing 14 about a rocker pivot axis 44A (see FIG. 5) between a panel-locking position associated with placement of the latch 16 in the extended position as suggested in FIGS. 5 and 6 and a panel-unlocking position associated with placement of the latch 16 in the retracted position as suggested in FIGS. 8 and 9. In illustrative embodiments, rocker 44 includes a magnet carrier 441, a drive arm 442, and a rocker axle 443 as suggested in FIG. 4. A post 444 is coupled to rocker 44 as suggested in FIGS. 10, 10A, and 11. Rocker 44 also includes a shoulder 442S and left and right limbs 442L, 442R coupled (e.g., cantilevered) to shoulder 442S and arranged to lie in spaced-apart relation to one another as shown, for example, in FIGS. 4 and 10A. Rocker axle 443 includes left and right axle pins 443L, 443R coupled to shoulder 442S and arranged to extend in opposite directions along rocker pivot axis 41A as suggested in FIGS. 4 and 10A, Motion-transfer link 46 is pivotably coupled at a first end thereof to rocker 44 to establish a first link pivot axis 46A1 and at a second end thereof to latch 16 to establish a second link pivot axis 46A2 as suggested in FIGS. 5 and 6. In illustrative embodiments, motion-transfer link 46 includes a rocker mount 461, a latch mount 462, a stretcher 463 arranged to interconnect rocker and latch mounts 461, 462, and an axle 464 as shown, for example, in FIG. 4. Axle 464 is coupled to rocker mount 461 and arranged to extend along first link pivot axis 46A1. Latch mount 462 is formed to include an axle-receiving passageway 465 sized to receive latch axle 41 therein.

Internal magnet 22I is coupled to rocker 44 to move therewith and arranged to lie in spaced-apart relation to the first end 461 of motion-transfer link 46 to locate rocker pivot axis 44A therebetween as suggested in FIGS. 4 and 9. Internal magnet 221 is arranged to lie in the magnetic field produced by magnetic external key 18 when the magnetic external key 18 is mated with exterior wall 30E of panel 30 and to be drawn magnetically toward interior wall 301 of panel 30 and magnetic external key 18 on exterior wall 30E of panel 30 to cause relative pivoting movement of each of rocker 44, motion-transfer link 46, and latch 16 to move the latch 16 from the extended position to the retracted position as suggested in FIGS. 6 and 9.

Panel lock 40 includes latch-return spring 42 and latch axle 41, along with latch 16 as suggested in FIG. 4. Spring 42 is configured to provide means for yieldably urging latch 16 to pivot about latch pivot axis 16A away from the rocker 44 and toward the extended position as suggested in FIG. 6. Spring 42 is coupled to latch 16 and to motion-transfer link 46 as suggested in FIGS. 4, 6, and 9. Spring 16 is a torsion spring having a first leg 421 coupled to the motion transfer link 46, a second leg 422 coupled to latch 16, and a coil 423 arranged to interconnect first and second legs 421, 422 as suggested in FIG. 4. Coil 423 of the torsion spring is arranged to wind around second link pivot axis 46A2 as suggested in FIG. 6.

Rocker axis 44A and first and second link pivot axes 46A1, 46A2 are arranged to cause a first reference line R1 intersecting first and second link pivot axes 46A1, 46A2 to cooperate with a second reference line R2 intersecting the rocker and first link pivot axes 44A, 46A1 to form an included angle θ therebetween that is substantially a right angle upon movement of latch 16 to the extended position as suggested in FIG. 6. That included angle θ is an obtuse angle upon movement of latch 16 to the retracted position a suggested in FIG. 9. The obtuse angle has a measure of about 113° in an illustrative embodiment.

Rocker 44 includes a magnet carrier 441 formed to include a socket 422 and arranged to extend from rocker pivot axis 44A in a direction away from motion-transfer link 46 as suggested in FIG. 406. Rocker 44 also includes a drive arm 442 arranged to extend away from magnet carrier 441 to first link pivot axis 46A1. Internal magnet 22I is mounted in socket 422 to move with magnet carrier 441 during pivoting movement of rocker 44 about rocker pivot axis 44A. Drive arm 442 includes a first end that is coupled to magnet carrier 441 at a first end thereof as suggested in FIGS. 4 and 10A. Rocker 44 further includes a rocker axle 443 coupled to drive arm 442 and arranged to mate with actuator housing 14 to establish rocker pivot axis 44A. Drive arm 442 includes an opposite second end that is pivotably coupled to motion-transfer link 46 at first link pivot axis 46A1. Magnet carrier 441, drive arm 442, and rocker axle 443 cooperate to form a monolithic element made of a plastics material as suggested in FIGS. 4 and 10A.

Motion-transfer link 46 includes a rocker mount 461 at the first end thereof, a latch mount 462 at the second end thereof, and a stretcher 463 arranged to interconnect the rocker and latch mounts 461, 462. Rocker mount 461 is coupled to rocker 44 at first link pivot axis 46A1. Latch mount 462 is coupled to latch 16 at second link pivot axis 46A2. Latch-return spring 42 is coupled to stretcher 463 and to latch 16 and configured to provide means for yieldably urging latch 16 to pivot about latch pivot axis 16A toward the extended position. Motion-transfer link 46 further includes a first link axle 464 coupled to the latch mount and arranged to mate with rocker 44 at first link pivot axis 46A1.

Latch 16 includes an outer member 160 configured to mate with latch blocker 26 and arranged to move upwardly through latch window 140 during movement between the extended and retracted positions of latch 16 as suggested in FIGS. 4, 6, and 9. Latch 16 also includes a first inner member 161 arranged to extend between latch and second link pivot axes 16A, 46A2. Coil 423 of spring 42 is arranged to interconnect first and second legs 421, 422 and to lie in a space defined between latch mount 462 and first inner member 161 as suggested in FIGS. 4 and 5. Latch axle 41 is arranged to define the latch pivot axis 16A and to extend, in series, through aligned apertures formed in latch mount 462, coil 423, and first inner member 161. A second inner member 162 is arranged to lie in spaced-apart relation to first inner member 161 as suggested in FIG. 4. Latch axle 41 is arranged to extend through apertures formed in first and second inner members 161, 162.

Figure 10:
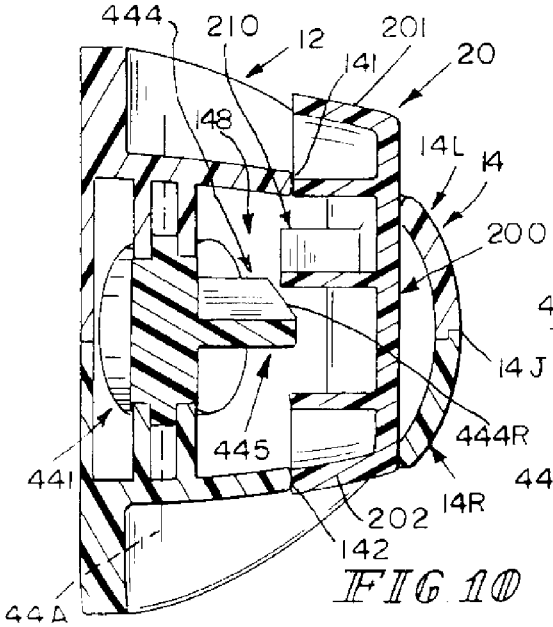
FIG. 10 is a horizontal sectional view taken along lines 10-10 of FIGS. 6 and 9 showing the internal key in the inactive position.
Figure 11:
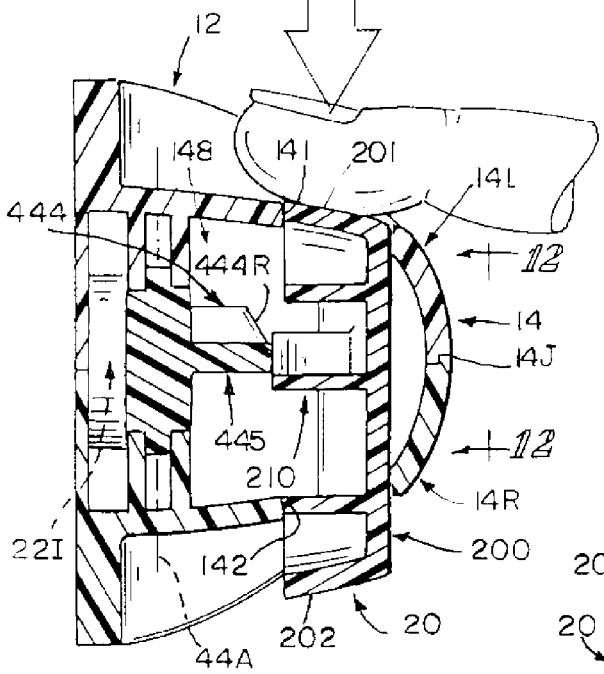
FIG. 11 is a sectional view similar to FIG. 10 showing movement of the internal key to an active position in the actuator housing in response to a push force applied by a person touching a left end of the internal key while the cabinet drawer is in an opened position as shown, for example, in FIG. 2.
Figure 12:
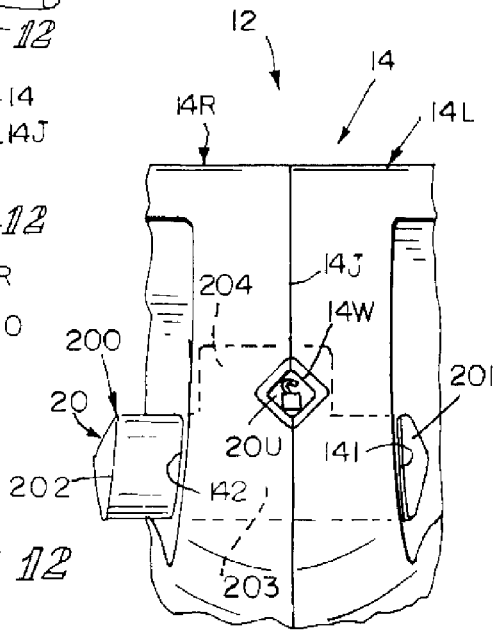
FIG. 12 is a rear elevation view (similar to FIG. 7) taken generally along lines 12-12 of FIG. 11 showing that sliding movement of the internal key has caused an unlocked symbol provided on the internal key to be visible in the observation window formed in the actuator housing to indicate that the internal key is now in the active position in the actuator housing wherein the internal key urges the latch actuator to assume a position moving the latch to the retracted position without using the magnetic external key.

Internal key 20 is arranged to move in latch chamber 148 relative to actuator housing 14 between (1) an inactive position disengaging rocker 44 to free rocker 44 for pivotable movement about rocker pivot axis 44 between the panel-locking and panel-unlocking positions and free latch 16 for movement between the extended and retracted positions as suggested in FIGS. 1, 2, 5-7, and 10 and (2) an active position providing means for engaging rocker 44 to retain rocker 44 in the panel-locking position upon movement of rocker 44 to the panel-locking position to cause latch 16 to remain in the retracted position without using magnetic external key 18 to expose magnet 22I to a magnetic field so that latch 16 remains in the retracted position without the use of magnets as suggested in FIGS. 3, 11, and 12. Latch-return spring 42 is coupled to latch 16 and to motion-transfer link 46 and configured to provide means for yieldably applying a first biasing force to motion-transfer link 46 to urge rocker 44 to assume the locked position and a second biasing force to latch 16 to urge latch 16 to assume the extended position until internal key 20 is moved to assume the active position.

Internal key 20 includes a handle 200 mounted for movement in latch chamber 148 during movement of internal key 20 between inactive and active positions as suggested in FIGS. 4, 10, and 12. Panel lock 40 further comprises cam means coupled to each of rocker 44 and to handle 220 for pivoting rocker 44 about rocker pivot axis 44A to the panel-unlocking position to move motion-transfer link 46 relative to actuator housing 14 to cause movement of latch 16 to the retracted position during sliding movement of internal key 20 from the inactive position to the active position. In illustrative embodiments, handle 200 includes a first button 201 at one end, a second button 202 at another end, and a button link 203 interconnecting first and second buttons 201, 202 as suggested in FIG. 4.

Figure 10A:
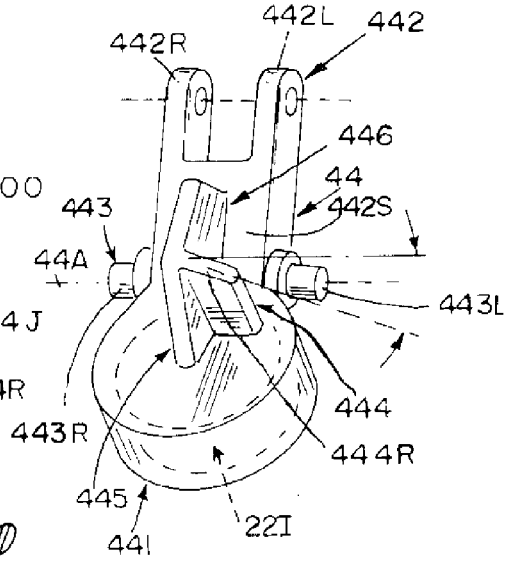
FIG. 10A is a view taken generally along line 10A-10A of FIG. 10 showing an inclined ramp associated with the rocker and arranged to be engaged by a rocker driver blade included in the internal key and coupled to the handle to move the rocker toward the drawer panel to cause the interior magnet carried by the rocker to lie against an interior wall of the drawer panel during sliding movement of the internal key from the inactive position shown in FIG. 10 to the active position shown in FIG. 11.

Cam means includes a post 444 coupled to rocker 44, arranged to extend away from panel 30 and toward the handle of internal key 20, and formed to include an inclined ramp 444R as shown in FIGS. 10, 10A, and 11. Cam means also includes a rocker driver blade 210 coupled to button link 203 of handle 200 to move therewith and engage inclined ramp 444R to apply a pivot-inducing torque to rocker 44 via post 444 to cause rocker 44 to pivot about rocker pivot axis 44A to assume the panel-unlocking position in response to sliding movement of internal key 20 from the inactive position to the active position and to retain rocker 44 in the panel-locking position as long as internal key 20 remains in the active position.

Actuator housing 14 includes a first key slot 141 opening into latch chamber 35 and a second key slot 142 lying in spaced-apart relation to first key slot 141 and opening into latch chamber 148 as suggested in FIGS. 4, 10, and 11. Internal key 20 includes a handle 200 arranged to extend through both of first and second key slots 141, 142 and mounted for back-and-forth sliding movement in latch chamber 148 and first and second key slots 141, 142 during movement of internal key 20 between the inactive and active positions.

Actuator housing 14 is also formed to include a flange-receiving channel 143 located in latch chamber 35 as suggested in FIG. 4. Internal key 20 further includes a guide flange 204 coupled to button link 203 of handle 200 to move therewith as suggested in FIG. 4. Guide flange 204 is arranged to slide back and forth in flange-receiving channel 143 to provide means for maintaining a predetermined orientation of handle 200 in latch chamber 35 during sliding movement of internal key 20 between the inactive and active positions as suggested in FIGS. 4, 10, and 11.

Latch 16 is mounted for pivotable movement relative to actuator housing 14 about a latch pivot axis 16A between an extended position extending out of latch chamber 35 through latch window 140 and a retracted position lying in latch chamber 148. Latch actuator 24 includes a linkage coupled to actuator housing 14 and to latch 16 for movement in latch chamber 148 between a first position associated with the extended position of latch 16 and a second position associated with the retracted position of latch 16. Latch actuator 24 also includes an internal magnet 22I arranged to lie in latch chamber 148 and coupled to the linkage to move therewith.

Magnetic external key 18 is configured to provide means lying outside of latch chamber 148 for exposing internal magnet 22I to a magnetic field to cause the linkage to move from the first position to the second position to move latch 16 from the extended position to the retracted position. Magnetic external key 18 includes an external magnet 22E.

Internal key 20 is arranged to move in latch chamber 35 relative to actuator housing 14 between (1) an inactive position disengaging the linkage to free the linkage for movement between the first and second positions so as to free latch 16 for movement between the extended and retracted positions and (2) an active position engaging the linkage upon movement of the linkage to the second position to cause the linkage to remain in the second position and latch 16 to remain in the retracted position without using magnetic external key 18 to expose internal magnet 22I in latch actuator 24 to a magnetic field.

Figure 7:
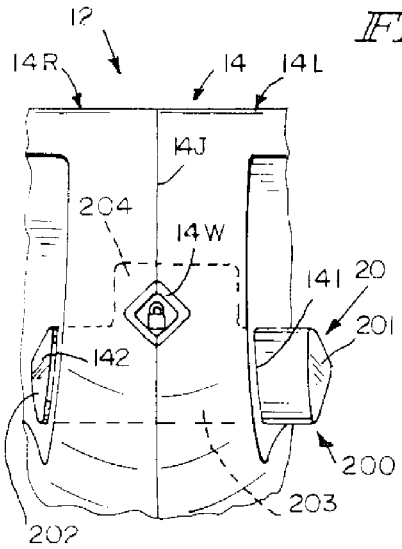
FIG. 7 is a rear elevation view taken generally along lines 7-7 of FIG. 6 showing an observation window formed in a rear wall of the actuator housing along a joint between the two shells comprising the actuator housing and showing that a locked symbol provided on the internal key is visible in the observation window to indicate that the internal key is located in the inactive position in the actuator housing.

As suggested in FIGS. 4, 7, and 12, an observation window 14W is formed in a rear wall of actuator housing 14 along joint 14J between shells 14L, 14R. Only a "locked" symbol 20L provided on the back of guide flange 204 of internal key 20 is visible in observation window 14W to indicate that internal key 20 is located in the inactive position in actuator housing 14 as suggested in FIGS. 6, 7, and 10. In contrast, only a neighboring "unlocked" symbol 20V provided on the back of guide flange 204 of internal key 20 is visible in observation window 14W to indicate that internal key 20 is located in the active position in the actuator housing as suggested in FIGS. 11 and 12.

Internal key 20 is shown in the inactive position in FIG. 10. An inclined ramp 444R is associated with rocker 44 and arranged to be engaged by a rocker driver blade 210 included in internal key 20 and coupled to handle 200. Such engagement moves the rocker 44 toward drawer panel 30 to cause the interior magnet 22I carried by rocker 44 to lie against an interior wall 301 of drawer panel 30 during sliding movement of internal key 20 from the inactive position shown in FIG. 10 to the active position shown in FIG. 11. Movement of internal key 20 to an active position in actuator housing 14 in response to a push force applied by a person touching a left end 201 of internal key 20 while cabinet drawer 34 is in an opened position is shown, for example, in FIG. 2. Sliding movement of internal key 20 has caused an unlocked symbol 200 provided on internal key 20 to be visible in observation window 14W formed in actuator housing 14 to indicate that internal key 20 is now in the active position in actuator housing 14 wherein internal key 20 urges latch actuator 24 to assume a position moving latch 16 to the retracted position without using the magnetic external key 20.

In use, when magnetic external key 19 is placed near internal magnet 22I, rocker 44 pivots, causing motion-transfer link 46 to shift and move away from magnetic external key 18 as suggested in FIGS. 6 and 9. This motion of motion-transfer link 46 pivots latch 16 to a retracted position in actuator housing 14 and loads latch-return spring 42. When magnetic external key 18 is separated from panel 30 to move away from internal magnet 22I, latch-return spring 442 is freed to return latch 16 to the extended position projecting upwardly through a latch window 140 formed in actuator housing 14.

It is also possible to retract latch 16 without the use of magnets. Internal key 20 can be moved in a passageway formed in actuator housing 14 to an active position to pivot rocker 44 and cause motion-transfer link 46 to move and pivot latch 16 to the retracted position as suggested in FIGS. 2, 3, and 10-12. Latch 16 then stays in the retracted position until internal key 20 is moved back to the inactive position shown in FIG. 10.

FIG. 10 is a horizontal sectional view taken along lines 10-10 of FIGS. 6 and 9 showing the internal key in the inactive position;

FIG. 10A is a view taken generally along line 10A-10A of FIG. 10 showing an inclined ramp formed on the rocker and arranged to be engaged by a rocker driver blade included in the internal key and coupled to the handle to move the rocker toward the drawer panel to cause the interior magnet carried by the rocker to lie against an interior wall of the drawer panel during sliding movement of the internal key from the inactive position shown in FIG. 10 to the active position shown in FIG. 11;

FIG. 11 is a sectional view similar to FIG. 10 showing movement of the internal key to an active position in the actuator housing in response to a push force applied by a person touching a left end of the internal key while the cabinet drawer is in an opened position as shown, for example, in FIG. 2; and FIG. 12 is a rear elevation view (similar to FIG. 7) taken generally along lines 12-12 of FIG. 11 showing that sliding movement of the internal key has caused an unlocked symbol provided on the internal key to be visible in the observation window formed in the actuator housing to indicate that the internal key is now in the active position in the actuator housing wherein the internal key urges the latch actuator to assume a position moving the latch to the retracted position without using the magnetic external key.

The invention claimed is:

1. A cabinet security system comprising a latch blocker adapted to be coupled to a frame included in a cabinet and formed to include an aperture opening into an interior region formed in the cabinet, a magnetic external key separated from the cabinet and adapted to mate with an exterior wall of a panel included in the cabinet and mounted for movement relative to the frame to open and close the aperture formed in the frame, and a panel motion controller adapted to be mounted on an opposite interior wall of the panel to lie in the interior region of the cabinet when the panel is closed, wherein the panel motion controller comprises an actuator housing formed to include a latch window opening into a latch chamber formed in the actuator housing, a panel lock including a latch mounted for pivotable movement relative to the actuator housing about a latch pivot axis between an extended position extending through the latch window to lie in confronting relation to the latch blocker when the panel is closed and a retracted position lying in the latch chamber to disengage the latch blocker to free the panel for movement relative to the frame to an opened position, and a latch actuator located in the latch chamber and configured to provide means for moving the latch from the extended position to the retracted position in response to exposure to a magnetic field produced by the magnetic external key when the magnetic external key is mated with the exterior wall of the panel, the latch actuator including a rocker mounted for pivotable movement relative to the actuator housing about a rocker pivot axis between a panel-locking position associated with placement of the latch in the extended position and a panel-unlocking position associated with placement of the latch in the retracted position, a motion-transfer link pivotably coupled at a first end thereof to the rocker to establish a first link pivot axis and at a second end thereof to the latch to establish a second link pivot axis, and an internal magnet coupled to the rocker to move therewith and arranged to lie in spaced-apart relation to the first end of the motion-transfer link to locate the rocker pivot axis therebetween and to lie in the magnetic field produced by the magnetic external key when the magnetic external key is mated with the exterior wall of the panel and to be drawn magnetically toward the interior wall of the panel and the magnetic external key on the exterior wall of the panel to cause relative pivoting movement of each of the rocker, motion-transfer link, and latch to move the latch from the extended position to the retracted position.

2. The system of claim 1, wherein the panel lock further includes spring means for yieldably urging the latch to pivot about the latch pivot axis away from the rocker and toward the extended position.

3. The system of claim 2, wherein the spring means is coupled to the latch and to the motion-transfer link.

4. The system of claim 2, wherein the spring means is a torsion spring having a first leg coupled to the motion-transfer link, a second leg coupled to the latch, and a coil arranged to interconnect the first and second legs.

5. The system of claim 4, wherein the coil of the torsion spring is arranged to wind around the second link pivot axis.

6. The system of claim 1, wherein the rocker axis and the first and second link pivot axes are arranged to cause a first reference line intersecting the first and second link pivot axes to cooperate with a second reference line intersecting the rocker and first link pivot axes to form an included angle therebetween that is substantially a right angle upon movement of the latch to the extended position and an obtuse angle upon movement of the latch to the retracted position.

7. The system of claim 6, wherein the panel lock further includes a torsion spring having a first leg coupled to the motion-transfer link, a second leg coupled to the latch, and a coil arranged to interconnect the first and second legs and wind around the second link pivot axis.

8. The system of claim 6, wherein the obtuse angle has a measure of about 113°.

9. The system of claim 1, wherein the rocker includes a magnet carrier formed to include a socket and arranged to extend from the rocker pivot axis in a direction away from the motion-transfer link and a drive arm arranged to extend away from the magnet carrier to the first link pivot axis and the internal magnet is mounted in the socket to move with the magnet carrier during pivoting movement of the rocker about the rocker pivot axis.

10. The system of claim 9, wherein the drive arm includes a first end that is coupled to the magnet carrier at a first end thereof and the rocker further includes a rocker axle coupled to the drive arm and arranged to mate with the actuator housing to establish the rocker pivot axis.

11. The system of claim 9, wherein the drive arm includes an opposite second end that is pivotably coupled to the motion-transfer link at the first pivot axis.

12. The system of claim 10, wherein the magnet carrier, drive arm, and rocker axle cooperate to form a monolithic element made of a plastics material.

13. The system of claim 1, wherein the motion-transfer link includes a rocker mount at the first end thereof, a latch mount at the second end thereof, and a stretcher arranged to interconnect the rocker and latch mounts, the rocker mount is coupled to the rocker at the first link pivot axis, and the latch mount is coupled to the latch at the second link pivot axis.

14. The system of claim 13, wherein the panel lock further includes spring means coupled to the stretcher and to the latch for yieldably urging the latch to pivot about the latch pivot axis toward the extended position.

15. The system of claim 13, wherein the motion-transfer link further includes a first link axle coupled to the latch mount and arranged to mate with the rocker at the first link pivot axis.

16. The system of claim 13, wherein the latch includes an outer member configured to mate with the latch blocker and arranged to move through the latch window during movement between the extended and retracted positions of the latch and a first inner member arranged to extend between the latch and second link pivot axes and the panel lock further includes a torsion spring having a first leg coupled to the motion-transfer link, a second leg coupled to the first inner member, and a coil arranged to interconnect the first and second legs, lie in a space defined between the latch mount and the first inner member, and wind around the second link pivot axis.

17. The system of claim 16, wherein the panel lock further includes a latch axle arranged to define the latch pivot axis and to extend, in series, through aligned apertures formed in the latch mount, coil, and first inner member.

18. The system of claim 1, further comprising an internal key arranged to move in the latch chamber relative to the actuator housing between an inactive position disengaging the rocker to free the rocker for pivotable movement about the rocker pivot axis between the panel-locking and panel-unlocking positions and free the latch for movement between the extended and retracted positions and an active position providing means for engaging the rocker to retain the rocker in the panel-locking position upon movement of the rocker to the panel-locking position to cause the latch to remain in the retracted position without using the magnetic external key to expose the internal magnet to a magnetic field so that the latch remains in the retracted position without the use of magnets.

19. The system of claim 18, wherein the panel lock further includes a spring coupled to the latch and to the motion-transfer link and configured to provide means for yieldably applying a first biasing force to the motion-transfer link to urge the rocker to assume the locked position and a second biasing force to the latch to urge the latch to assume the extended position until the internal key is moved to assume the active position.

20. The system of claim 18, wherein the actuator housing includes a first key slot opening into the latch chamber and a second key slot lying in spaced-apart relation to the first key slot and opening into the latch chamber, the internal key includes a handle arranged to extend through both of the first and second key slots and mounted for back-and-forth sliding movement in the latch chamber and the first and second key slots during movement of the internal key between the inactive and active positions, and further comprising cam means coupled to each of the rocker and to the handle for pivoting the rocker about the rocker pivot axis to the panel-unlocking position to move the motion-transfer link relative to the actuator housing to cause movement of the latch to the retracted position during sliding movement of the internal key from the inactive position to the active position.

21. The system of claim 18, wherein the internal key includes a handle mounted for movement in the latch chamber during movement of the internal key between inactive and active positions and the panel lock further comprises cam means coupled to each of the rocker and to the handle for pivoting the rocker about the rocker pivot axis to the panel-unlocking position to move the motion-transfer link relative to the actuator housing to cause movement of the latch to the retracted position during sliding movement of the internal key from the inactive position to the active position.

22. The system of claim 21, wherein the rocker includes a magnet carrier formed to include a socket and arranged to extend from the rocker pivot axis in a direction away from the motion-transfer link and a drive arm arranged to extend away from the magnet carrier to the first link pivot axis, the internal magnet is mounted in the socket to move with the magnet carrier during pivoting movement of the rocker about the rocker pivot axis, and the cam means includes a post coupled to the rocker, arranged to extend away from the panel and toward the handle of the internal key, and formed to include an inclined ramp, and a rocker driver blade coupled to the handle to move therewith and engage the inclined ramp to apply a pivot-inducing torque to the rocker via the post to cause the rocker to pivot about the rocker pivot axis to assume the panel-unlocking position in response to sliding movement of the internal key from the inactive position to the active position and to retain the rocker in the panel-locking position as long as the internal key remains in the active position.

23. The system of claim 21, wherein the panel lock further includes a spring coupled to the latch and to the motion-transfer link and configured to provide means for yieldably applying a biasing force to the motion-transfer link to urge the rocker to assume the panel-locking position and a biasing force to the latch to urge the latch to assume the extended position until the internal key is moved to assume the active position, a post formed to include an inclined ramp, and a rocker driver blade coupled to the handle to move therewith and engage the inclined ramp to apply a pivot-inducing torque to the rocker via the post to cause the rocker to pivot about the rocker pivot axis to load the spring and to assume the panel-unlocking position in response to sliding movement of the internal key from the inactive position to the active position and to retain the rocker in the panel-locking position as long as the internal key remains in the active position.

24. The system of claim 22, wherein the actuator housing is formed to include a flange-receiving channel located in the latch chamber and the internal key further includes a guide flange coupled to the handle to move therewith and arranged to slide back and forth in the flange-receiving channel to provide means for maintaining a predetermined orientation of the handle in the latch chamber during sliding movement of the internal key between the inactive and active positions.

25. The system of claim 24, wherein the panel lock further includes a spring coupled to the latch and to the motion-transfer link and configured to provide means for yieldably applying a biasing force to the motion-transfer link to urge the rocker to assume the panel-locking position and a biasing force to the latch to urge the latch to assume the extended position until the internal key is moved to assume the active position, a post formed to include an inclined ramp, and a rocker driver blade coupled to the handle to move therewith and engage the inclined ramp to apply a pivot-inducing torque to the rocker via the post to cause the rocker to pivot about the rocker pivot axis to load the spring and to assume the panel-unlocking position in response to sliding movement of the internal key from the inactive position to the active position and to retain the rocker in the panel-locking position as long as the internal key remains in the active position.

26. A cabinet security system comprising a magnetic external key, an internal key, an actuator housing formed to include a latch window opening into a latch chamber formed in the actuator housing, a panel lock including a latch mounted for pivotable movement relative to the actuator housing about a latch pivot axis between an extended position extending through the latch window to lie in confronting relation to the latch blocker when the panel is closed and a retracted position lying in the latch chamber to disengage the latch blocker to free the panel for movement relative to the frame to an opened position, and a latch actuator located in the latch chamber and configured to provide means for moving the latch from the extended position to the retracted position in response to exposure to a magnetic field produced by the magnetic external key when the magnetic external key is mated with the exterior wall of the panel, the latch actuator including a rocker mounted for pivotable movement relative to the actuator housing about a rocker pivot axis between a panel-locking position associated with placement of the latch in the extended position and a panel-unlocking position associated with placement of the latch in the retracted position, a motion-transfer link pivotably coupled at a first end thereof to the rocker to establish a first link pivot axis and at a second end thereof to the latch to establish a second link pivot axis, and an internal magnet coupled to the rocker to move therewith and arranged to lie in spaced-apart relation to the first end of the motion-transfer link to locate the rocker pivot axis therebetween and to lie in the magnetic field produced by the magnetic external key when the magnetic external key is mated with the exterior wall of the panel and to be drawn magnetically toward the interior wall of the panel and the magnetic external key on the exterior wall of the panel to cause relative pivoting movement of each of the rocker, motion-transfer link, and latch to move the latch from the extended position to the retracted position.

* * * * *